United States Patent [19]

Brown

[11] 4,108,044

[45] Aug. 22, 1978

[54] DEVICE FOR GREASING MUZZLE-LOADING BULLETS

[76] Inventor: Richard Brown, 468 Metzgar St., Half Moon Bay, Calif. 94019

[21] Appl. No.: 779,330

[22] Filed: Mar. 21, 1977

[51] Int. Cl.[2] ..... F42B 31/02

[52] U.S. Cl. ..... 86/19

[58] Field of Search ..... 86/1 R, 19, 42, 43

[56] References Cited

U.S. PATENT DOCUMENTS

| | | | |
|---|---|---|---|
| 476,175 | 5/1892 | Stewart | 86/19 |
| 2,133,873 | 10/1938 | Sharp | 86/19 |
| 2,403,032 | 7/1946 | Stevens | 86/19 |
| 2,535,616 | 12/1950 | Wadman et al. | 86/19 |
| 3,736,835 | 6/1973 | Hanson | 86/19 |
| 3,967,526 | 7/1976 | Leich | 86/19 |

*Primary Examiner*—Harold Tudor
*Attorney, Agent, or Firm*—Julian Caplan

[57] ABSTRACT

A cylindrical stock has a hand-operable piston disposed at one end and a cylindrical die screwed onto the other end, with a bullet-receiving adapter held in position within the die, the inner diameter of the adapter having a recessed portion defining a passage through which grease inserted into the cylindrical stock can be forced by the piston into grooves of the bullet. Adapters of differing inner diameters accommodate bullets of differing outer diameters, such that the device can be used for greasing bullets of different caliber.

6 Claims, 4 Drawing Figures

DEVICE FOR GREASING MUZZLE-LOADING BULLETS

This invention relates to a portable device for greasing muzzle-loading bullets.

Various machines and devices, such as those disclosed in U.S. Pat. No. 2,133,873 and No. 476,175, are available for use by individuals for greasing bullets. Typically, such devices have been designed to accomplish the sizing of bullets as well as the lubrication thereof. For the most part, such devices are of complex construction, resulting in substantial cost of fabrication. In other cases such devices have not been sufficiently trouble-free for the typical unskilled operator. Attempts to provide simpler devices, such as the early device described in U.S. Pat. No. 477,784, have failed in achieving their purpose. That is, there is presently available no truly portable device for greasing bullets which can be used by the average unskilled operator to grease a number of bullets in rapid succession.

In accordance with this invention, a stock having a grease-containing chamber is combined with a removable die which holds a bullet-receiving adapter in position against the stock such that a bullet can be manually inserted into the adapter with its base and rear portion in communication with the grease-containing chamber. The inner portion of the adapter is constructed to define passages or apertures adjacent the grooves of the bullets and communicating with the grease-containing chamber of the stock, such that when a piston disposed at the other end of the chamber is manually moved toward the inserted bullet, grease disposed in the chamber will be forced through the passages and into the grooves of the bullet. With the proper adapter inserted into the removable die, and grease placed in the piston chamber, the device can be assembled and a bullet inserted into the adapter for the greasing operation. The bullet is then manually removed and another inserted, and so on.

It is thus a primary object of this invention to provide rapid and trouble-free greasing of muzzle-loading bullets.

It is another object of this invention to provide a device which can fill one or more grooves of a muzzle-loading bullet.

It is a further object of this invention to provide a device for greasing bullets which uses adapters to accommodate bullets of different caliber.

It is yet a further object of this invention to provide a truly portable, lightweight, and inexpensive device for greasing muzzle-loading bullets.

Other objects of the present invention will become apparent upon reading the following specification and referring to the accompanying drawing in which similar characters of reference represent corresponding parts in each of the several views.

Figure 1:
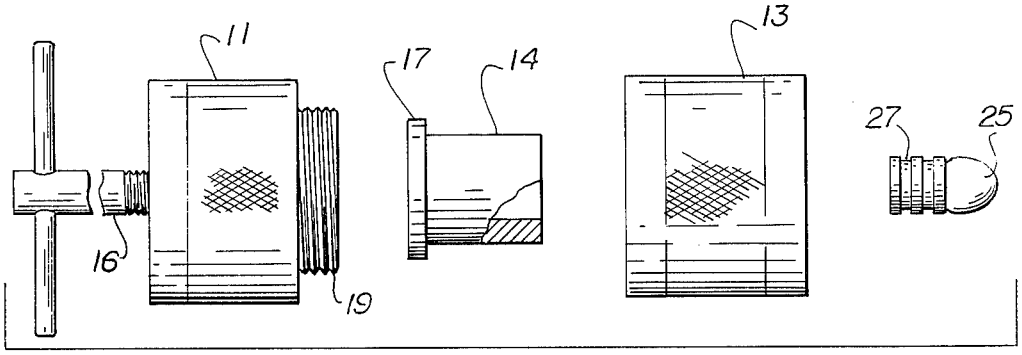
FIG. 1 is an exploded view of the device in side elevation, with a muzzle-loading bullet in position for insertion.

The present invention comprises four parts, namely, stock 11, piston 12, die 13, and adapter 14. The stock 11 has grease-containing chamber 15, in which piston 12 can be moved in the direction of the arrow by turning of screw threaded rod 16. Adapter 14 has annular flange 17, and die 13 is provided with an annular shoulder 18 such that the adapter can be inserted into the die with the annular flange 17 abutting the shoulder 18. With the adapter so positioned, die 13 can be screwed onto the threaded extension 19 of stock 11.

The adapter 14 has an inner diameter 21 slightly greater than the outer diameter of a particular caliber bullet for which it is designed. Additionally, the adapter 14 is provided with base portion 23 against which the rear end of bullet 25 abuts following insertion of the bullet prior to the greasing operation. The inner recessed portion 22 of adapter 14 defines a passage 26 communicating on one side with the grease-containing chamber 15 and on the other side with the grooves 27 of bullet 25.

Figure 3:
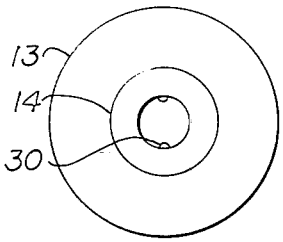
FIG. 3 is an end view of the device shown in FIG. 2.

As shown in FIG. 3, adapter 14 fits within die 13 to define a compact device of cylindrical character which is truly portable. Arcuate slots 30 formed in adapter 14 are for grease to flow into provided slots in bullet.

Figure 4:
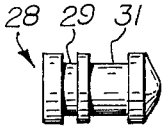
FIG. 4 is a side elevational view of a muzzle-loading bullet having grooves dissimilar to those of the bullet shown in FIG. 1.

The device of this invention can be used to fill one or more grooves of muzzle-loading bullets. Additionally, such device can be used to grease grooves of differing lengths and shapes, such as the short and long grooves 29, 31 of the bullet 28 shown in FIG. 4.

The device of this invention is preferably constructed entirely of teflon, but it can be made from any other similar low cost material, to thereby provide a simple, low cost, and trouble-free device for greasing muzzle-loading bullets.

Figure 2:
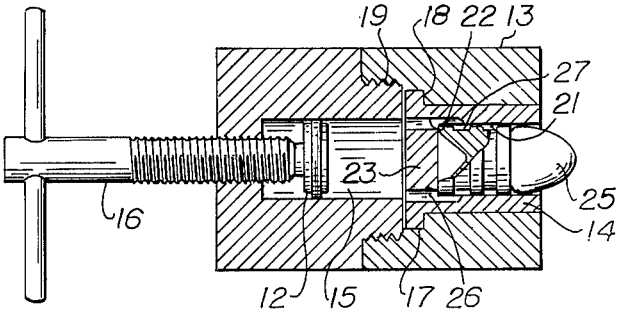
FIG. 2 is a view similar to that of FIG. 1 but showing the device assembled and partly broken away to show the piston within the grease-containing chamber and passages leading to the grooves of the inserted bullet.

In use of the device, grease is placed in chamber 15 of stock 11 and the appropriate adapter 14 is inserted into die 13. The die 13 is screwed onto stock 11 and a bullet is inserted backwards into the adapter until it abuts base 23 thereof, as shown in FIG. 2. Rod 16 is turned to move piston 12 against the grease, forcing it through passages 26 into grooves 27 of the bullet 25. The bullet 25, fully greased, is then manually removed and another bullet similarly inserted for the next greasing operation, and so on. It will be necessary to disassemble the device only in order to add grease to chamber 15 or to change adapter 14 to accommodate bullets of different caliber, such disassembly being accomplished in a matter of seconds.

I claim:

1. A portable, pocket size device for greasing muzzle-loading type bullets comprising a stock having a grease-containing chamber, hand-operable piston means for forcing grease through the chamber, a removable die attachable to an open end of the stock chamber in axial alignment therewith, the cylindrical adapter removably held by the die against the open end of the stock chamber, the adapter having a base portion to limit the depth of insertion of a bullet into the adapter and an inner portion defining a passage around the base portion such that grease in the chamber can be forced by the piston through the passage and into the grooves of the bullet.

2. The device of claim 1 wherein the stock comprises a cylinder having an O-ring piston disposed at its closed end, the other end having a reduced diameter, screw-threaded extension, and wherein the removable die is cylindrical and is threaded such that it can be screwed onto the extension of the cylindrical stock.

3. The device of claim 1 wherein the cylindrical adapter is one of a series of adapters having differing inner diameters so as to accommodate different caliber bullets.

4. The device of claim 1 wherein the die has an inner, annular shoulder and the adapter has an annular flange, such that the adapter can be inserted into the cylindrical die with its annular flange abutting the annular shoulder of the die.

5. The device of claim 1 wherein the inner portion of the adapter defining the grease passage comprises a reduced diameter portion of the adapter.

6. The device of claim 1 wherein all of the parts are constructed of Teflon.

* * * * *